US005538213A

United States Patent [19]

Brown

[11] Patent Number: 5,538,213

[45] Date of Patent: Jul. 23, 1996

[54] BRACKET FOR SHELVING, FURNITURE AND THE LIKE

[75] Inventor: Vernon Brown, Dallas, Tex.

[73] Assignee: Brown Office Systems, Inc., Dallas, Tex.

[21] Appl. No.: 309,683

[22] Filed: Sep. 21, 1994

[51] Int. Cl.[6] ..... A47B 96/06

[52] U.S. Cl. ..... 248/222.11; 108/108; 248/250

[58] Field of Search ..... 248/222.1, 220.2, 248/221.3, 224.4, 243, 250, 225.2; 108/108; 211/192

[56] References Cited

U.S. PATENT DOCUMENTS

| | | | |
|---|---|---|---|
| 3,891,172 | 6/1975 | Einhorn | 248/222.1 X |
| 4,004,856 | 1/1977 | Wesseler | 248/222.1 X |
| 4,154,419 | 5/1979 | Breindenbach | 211/192 X |
| 4,387,872 | 6/1983 | Houge | 248/221.3 |
| 4,971,281 | 11/1990 | Steinbeck | 248/222.1 X |
| 5,022,621 | 6/1991 | Quest | 248/222.1 X |
| 5,063,715 | 11/1991 | Goodman | 211/192 X |

*Primary Examiner*—Ramon O. Ramirez
*Attorney, Agent, or Firm*—John M. Cone; Strasburger & Price

[57] ABSTRACT

A multi-hook bracket for supporting shelving furniture, and the like, includes a horizontally moveable lock that can engage into an aperture in the support standard in which the bracket is mounted.

The lock has a key-hole opening to receive a tool that enables a force to be applied between the lock and the main body of the bracket to move the lock horizontally to engage and disengage it from the aperture in the standard.

7 Claims, 2 Drawing Sheets

11
13
15
17
19
21
23
25
26
26a
26b
26c
26d
26e
27
28a
28b
29
31
h'
h²
4
5

BRACKET FOR SHELVING, FURNITURE AND THE LIKE

BACKGROUND OF THE INVENTION

The present patent relates to multi-hook brackets for supporting shelving, furniture, and the like.

One common form of support for shelving, office equipment, furniture and the like comprises a series of vertically extending support standards that are spaced horizontally apart and each of which has an array of vertically spaced apertures that receive hooks extending from a vertical edge of a generally horizontally disposed cantilever support arm. Examples of this type of support system can be seen in U.S. Pat. Nos. 5,022,621 (Quest) and 4,387,872 (Hogue).

OBJECT OF THE INVENTION

Quest and Hogue also show locking arrangements that prevent inadvertent removal of the hooks of the cantilever arm from the support standards.

A disadvantage of the locking device shown in U.S. Pat. No. 5,022,621 is that when the lock 40, shown in FIG. 4 of the '621 Patent, is engaged in the partially occupied aperture 96 of the standard 90, as shown in phantom in FIG. 4 of the Patent, it cannot readily be retracted to remove the bracket 10 from the standard.

An object of the present invention is to improve on the type of system shown in U.S. Pat. No. 5,022,621 by providing a way of engaging and disengaging the lock.

SUMMARY OF THE INVENTION

According to the present invention there is provided a support bracket for shelving and the like, comprising: a main body having a vertical edge from which extend a plurality of spaced apart outwardly directed hooks for engaging the bracket on a vertical support standard with said hooks extending into vertical spaced apertures on the standard; a lock for preventing removal of the bracket from the standard, said lock comprising a member that is movably mounted on the body of the bracket for displacement towards and away from the support standard between a locked and unlocked position and including a portion that is adapted to engage in an aperture of the support standard, the lock having an aperture for receiving a tool for moving the lock towards and away from the said vertical edge to engage and disengage the lock with a standard aperture respectively. The aperture is so positioned that when the lock is engaged the tool can apply a force between the lock and the body in a direction to move the lock from the locked to unlocked position and when the lock is disengaged in a direction to move the lock from the unlocked to the locked position.

BRIEF DESCRIPTION OF THE DRAWINGS

Preferred embodiments of the invention will now be described, by way of example only, with reference to the accompanying drawings in which.

DESCRIPTION OF THE PREFERRED EMBODIMENT

Figure 1:
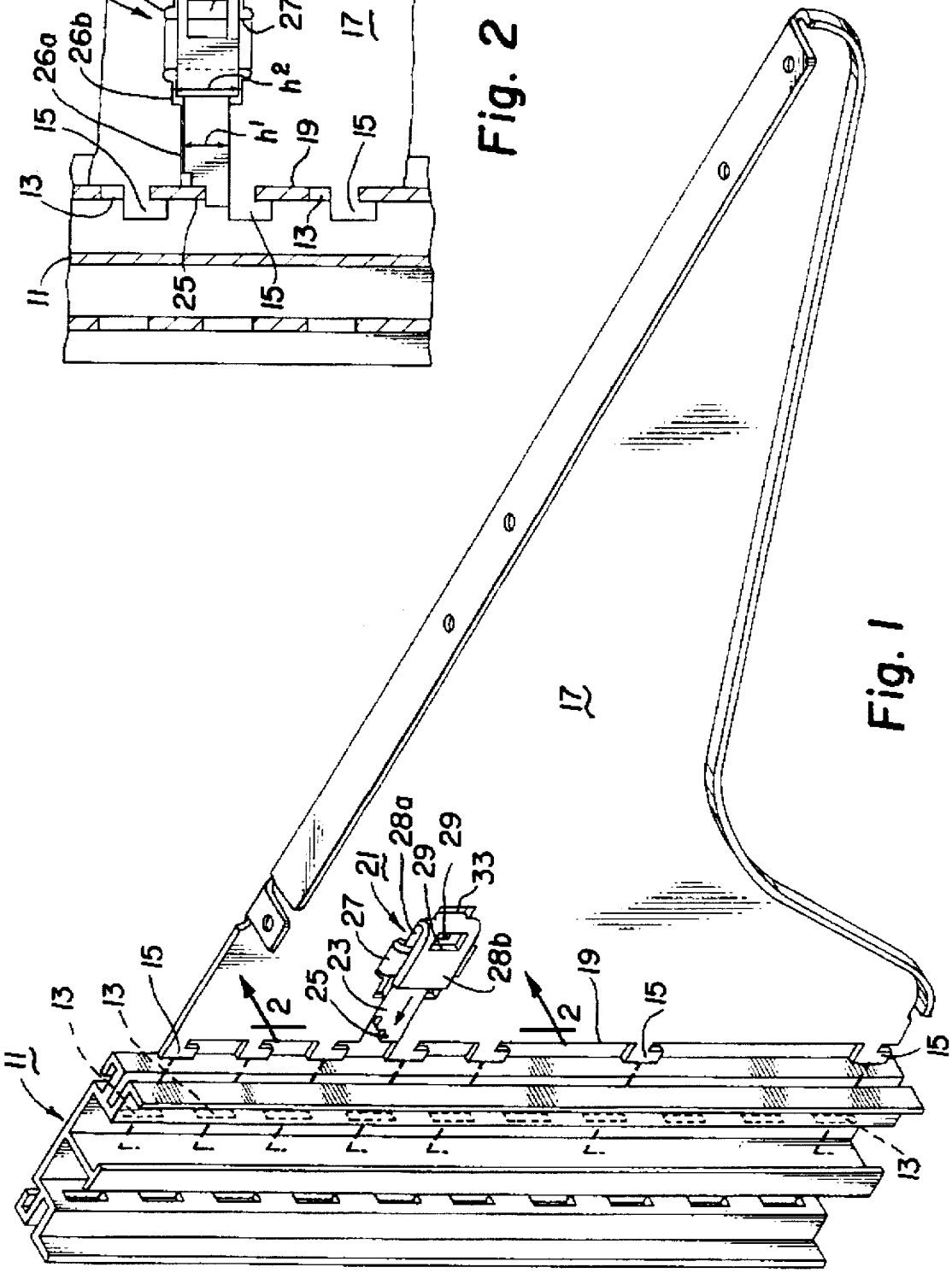
FIG. 1 shows a perspective view of a first embodiment of the invention.

FIG. 1 shows part of a support system for office furniture which comprises a series of vertically extending standards 11, one of which is shown in FIG. 1, secured, in a manner well known in the art, to a wall or other structure and horizontally spaced apart at distances dictated by the size and weight of the objects to be supported by the system.

Each standard 11 comprises a channel section member which has a vertically spaced-apart series of apertures 13 for receiving hooks 15 of a horizontal support bracket 17. As seen in FIG. 1, the bracket 17 has a plurality of spaced apart hooks 15 extending from a rear vertical edge 19 of the bracket 17. The spacing of the hooks 15 and their size and shape is such that each hook is adapted to engage in an aperture 13 of the standard 11 to mount the bracket 17 on the standard 11, as seen in FIG. 1.

The invention of U.S. Pat. No. 5,022,621 provides a lock that can be engaged to fill the unoccupied space between the upper edge of a hook 15 and the margin of the aperture 13 in which the hook 15 is engaged to prevent vertical upward movement, and hence disengagement, of the hook 15. As seen in FIG. 1, the embodiment of the present invention includes a lock 21 comprising a flat plate 23 having a forward locking edge 25 which may be stepped, as shown in FIG. 1. In other forms of the invention, not shown on the drawings, the forward locking edge 25 may be chamfered to engage in different sizes of apertures 13, or may be of a single thickness.

Figure 2:
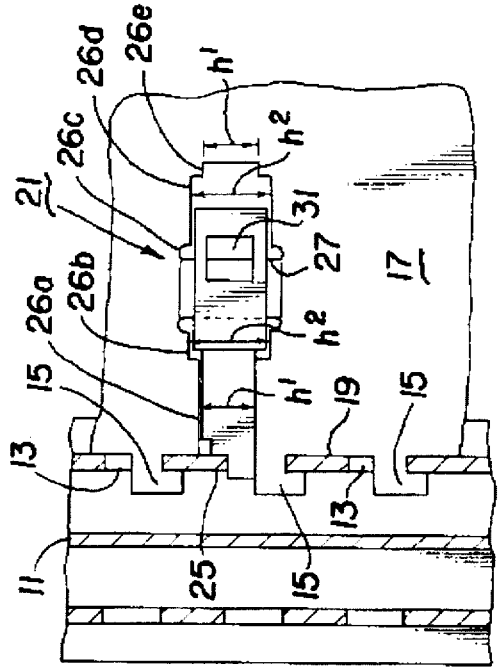
FIG. 2 is a vertical section of the line 2—2 in FIG. 1.

The plate 23 is accommodated in a channel 26 formed by an omitted portion in the vertical edge 19 of bracket 17. The channel 26 extends from the edge 19 of the bracket essentially horizontally and has a series of sections 26*a*, 26*b*, 26*c*, 26*d*, and 26*e* of different vertical dimension or width. As seen in FIG. 2, Sections 26*a* and 26*e* are of the same vertical dimension, h1, and sections 26*b* and 26*d* are of the same vertical dimension, h2.

A portion of the bracket 17 is displaced from the plane of the bracket to form a bridge 27 between the two sides of the channel 26 in the region of the section 26*c*. The plate 23 has the form of a U, having limbs 28*a* and 28*b* surrounding, and slidably mounted on, the bridge 27. The limb 28*a* of the U has an extension which forms the locking edge 25. In the main spaced-apart portions of the limbs 28*a* and 28*b* are formed two rectangular openings 29, one in each limb of the U. The openings 29 are in register with each other.

The vertical dimension of the main portion of the plate 23 is just slightly less than that of the width h1 of the channel sections 26*b* and 26*d*, but is greater than the width h2 of the channel sections 26*a* and 26*e*. This means that the plate 23 is free to move between an unlocked position, shown in FIG. 1, in which the locking portion 25 is disengaged from the aperture 13 of the standard 11 and a locked position, shown in FIG. 2, in which the outer end of the locking portion 25 fills the unoccupied part of the aperture 19 above the hook 15.

As seen in FIG. 2, when the lock 21 is engaged, there is a space 31 between the vertical side of the bridge 27 and the margins of the openings 29 in which a tool, for example a screwdriver, can be inserted to apply a separating force between the bridge 27 and the plate 23 to move the plate 23 to the right as seen in FIG. 2 and unlock the lock 21 to allow the bracket 17 to be moved vertically and disengaged from the standard 11. Similarly, when the lock 21 is disengaged, as in FIG. 1, there is a space 33 between the end of the plate 23 and the inner end of the channel 26 which can receive the tool, and enable a force to be applied between the bracket 17 and the plate 23 to move the plate 23 to the left as seen in FIG. 1.

Figures 3, 4, 5:
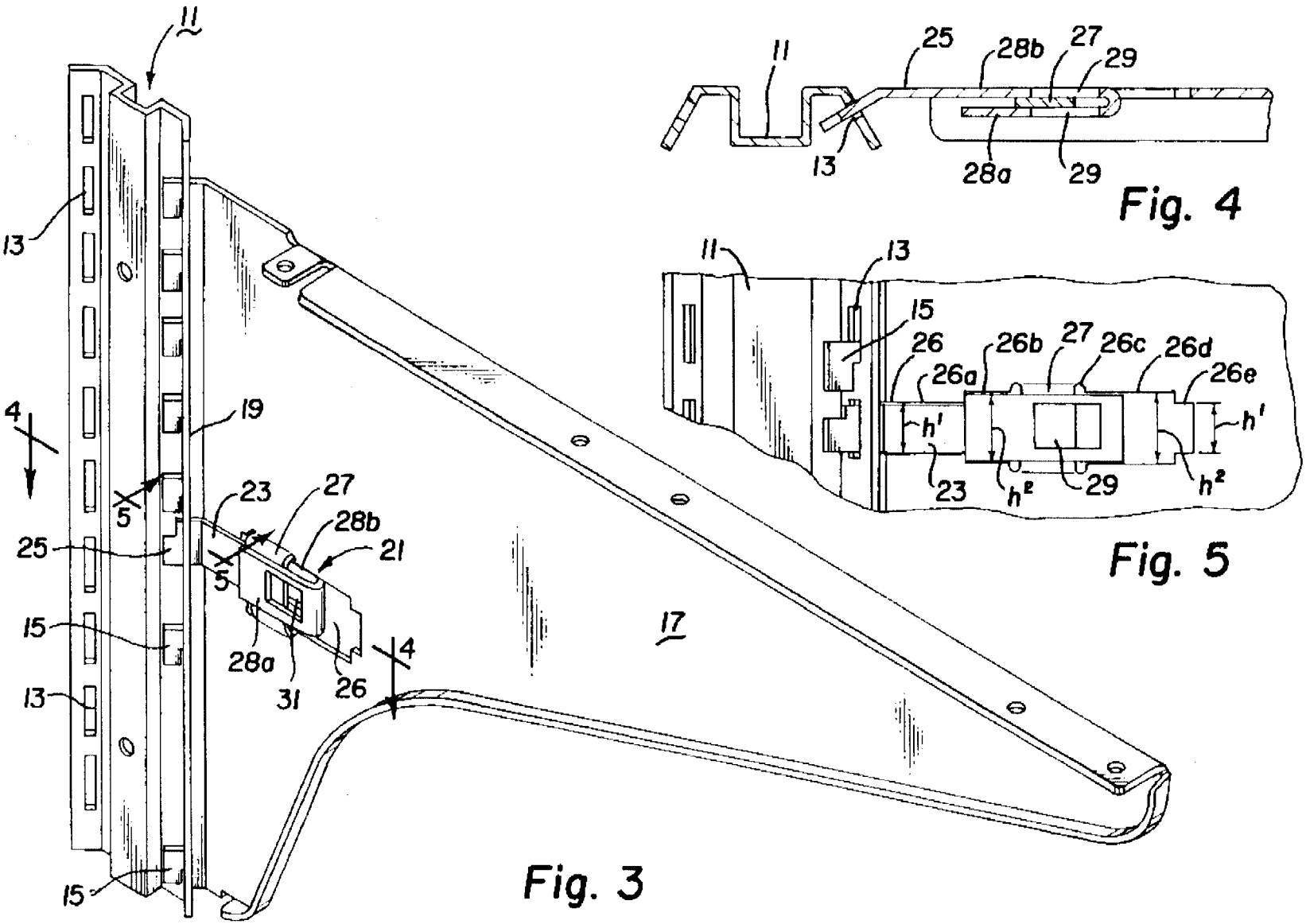
FIG. 3 is a perspective view of a second embodiment.
FIG. 4 is a horizontal section on the line 4—4 in FIG. 3.
FIG. 5 is a side elevation of part of the second embodiment in the direction 5—5 in FIG. 3.

FIGS. 3–5 show a second preferred embodiment of the invention. The second preferred embodiment is similar to the first embodiment previously described and similar parts have been given the same reference number in the drawings.

The major difference between the first and second embodiments is that in the second embodiment, the lock 21 is disposed at a position on the vertical edge 19 of the bracket 17 where it is spaced away from the hooks. Thus, as best seen in FIG. 5, when the bracket 17 is mounted on a standard 11, and the lock 21 is engaged, the forward locking edge 25 enters and occupies an aperture 13 of the standard 11 which is not partially occupied the one of the hooks 15.

I claim:

1. A support bracket for shelving comprising:

a main body having a vertical edge from which extend a plurality of spaced apart, outwardly directed hooks for mounting the bracket on a vertical support standard with said hooks extending into vertically spaced apertures in the standard;

a lock for preventing removal of the bracket from the standard, said lock comprising a member that is movably mounted on the main body of the bracket for displacement towards and away from the support standard between a locked and unlocked position and including a portion adapted to engage in an aperture of the support standard, the lock being disposed on the vertical edge of the main body so that it enters and at least partially occupies an aperture of the support standard that is not partially occupied by one of the bracket's hooks.

2. A support bracket as claimed in claim 1 wherein the lock having an opening for receiving a tool for moving the lock towards and away from the said vertical edge, to engage and disengage the lock with a standard aperture respectively.

3. A support bracket as claimed in claim 2 wherein the opening is so positioned that when the lock is engaged the tool can apply a force between the lock and the body in a direction to move the lock from the locked to unlocked position and when the lock is disengaged in a direction to move the lock from the unlocked to the locked position.

4. A support bracket as claimed in claim 1 in which said lock comprises a U-shaped member slidably mounted on a portion of the main body and accommodated in an open channel in the vertical edge of the main body, and an opening in the U-shaped member to enable a tool to be inserted to apply a force between the lock and the body to engage and disengage the lock.

5. A support bracket as claimed in claim 1 wherein the lock member is accommodated in a channel in the vertical edge of the main body and is mounted for sliding movement on a portion of the main body bridging the channel;

the lock having an opening located in a portion of the lock which is on the side of the bridging portion furthest from the standard, whereby a tool can be inserted in the opening to apply a force between the lock and the bridge to move the lock from the engaged position.

6. A support bracket for shelving comprising:

a main body having a vertical edge from which extend a plurality of spaced apart, outwardly directed hooks for mounting the bracket on a vertical support standard with said hooks extending into vertically spaced apertures on the standard;

a lock for preventing removal of the bracket from the standard;

said lock being located in an open channel in the vertical edge of the main body and movable towards and away from the support standard between a locked and unlocked position;

said lock comprising a U-shaped member having two opposed limbs which surround and slide on a bridge portion of the body that extends across the said open channel and an extended distal end portion that is adapted to engage in an aperture of the support standard.

7. A support bracket as claimed in claim 6 wherein the two limbs of the U-shaped member have registering openings disposed on the side of the bridge portion further from the open end of the channel to receive a tool, the channel having a closed inner end which provides an abutment surface for the tool when it is inserted between the inner end of the U-shaped member and the closed inner end of the channel to apply a force to the U-shaped member to move it towards the locking portion.

* * * * *